US005379014A

United States Patent [19]

Sato et al.

[11] Patent Number: 5,379,014

[45] Date of Patent: Jan. 3, 1995

[54] VACUUM CIRCUIT BREAKER

[75] Inventors: Takashi Sato; Yukio Kurosawa, both of Hitachi; Kouji Suzuki, Takahagi; Akira Hashimoto; Shunkichi Endoo, both of Hitachi, all of Japan

[73] Assignee: Hitachi, Ltd., Tokyo, Japan

[21] Appl. No.: 41,470

[22] Filed: Apr. 2, 1993

[30] Foreign Application Priority Data

Apr. 2, 1992 [JP] Japan ..... 4-081168

[51] Int. Cl.[6] ..... H01H 9/00

[52] U.S. Cl. ..... 335/177; 335/183

[58] Field of Search ..... 335/177, 178, 179, 180, 335/181, 182, 183

[56] References Cited

U.S. PATENT DOCUMENTS 3,372,258 5/1965 Porter .
4,130,781 12/1978 Dethiefsen .

FOREIGN PATENT DOCUMENTS

411663A3 3/1990 European Pat. Off. .
3910010 10/1989 Germany .
56-152126 11/1981 Japan .
3059920 3/1991 Japan .
2178901A 2/1987 United Kingdom .

*Primary Examiner*—Lincoln Donovan
*Attorney, Agent, or Firm*—Fay, Sharpe, Beall, Fagan, Minnich & McKee

[57] ABSTRACT

A vacuum circuit breaker comprising an external coil which is arranged outside a vacuum interrupter, and a power supply circuit which causes current to flow through the external coil. An overcurrent flowing through the main circuit of the circuit breaker, which leads to a load, is detected by an overcurrent tripping device so as to separate the movable electrode of the vacuum interrupter from the fixed electrode thereof and to subject a striking electric arc to a magnetic flux generated axially of the vacuum interrupter by the electrodes themselves. Thereafter, a trigger gap is ignited by a signal delivered from the overcurrent tripping device, so as to introduce a reverse current into the vacuum interrupter. Herein, the trigger gap is ignited by a signal delivered from the overcurrent tripping device, in order that the zero point of currents may be formed at the point of time at which the axial magnetic flux has been canceled by the resulting current of the external coil. Since the axial magnetic flux remaining at the zero point of the currents is nullified, charged particles are not hindered from diffusing radially of the vacuum interrupter, and hence, an enhanced breaking performance is attained.

16 Claims, 5 Drawing Sheets

VACUUM CIRCUIT BREAKER

BACKGROUND OF THE INVENTION

1. FIELD OF THE INVENTION

The present invention relates to a vacuum circuit breaker which employs a vacuum interrupter. The vacuum circuit breaker cuts off a current from flowing through a circuit in excess of a prescribed value, so as to protect the circuit.

2. DESCRIPTION OF THE RELATED ART

A vacuum circuit breaker recovers the electrical insulation between its main electrodes at the zero point of current and cut s off the current, thereby protecting a circuit from any overcurrent. By way of example, FIG. 8 of the accompanying drawings illustrates the circuit arrangement of a DC (direct-current) vacuum circuit breaker (also termed "DC circuit breaker") having hitherto been conventional, while FIG. 9 illustrates the operating principles of the DC circuit breaker.

Referring to FIG. 8, the DC circuit breaker 1 is constructed of a vacuum interrupter 2, a commutating capacitor 5, a commutating reactor 6, a trigger gap 8, an electromagnetic repulsion coil 3, a short-circuit ring 4, an overcurrent tripping device 7, and a zinc-oxide (ZnO) non-linear resistance element 9.

In the prior-art circuit breaker 1 constructed as stated above, the commutating capacitor 5 is previously charged by a charging device with such a polarity the that stored charge becomes negative on the side of a DC power source 10 and positive on the side of a load 11 as shown in FIG. 8. When an overcurrent $I_0$ has flowed through the main circuit of the circuit breaker 1, it is detected by the overcurrent tripping device 7. Simultaneously with the detection, the overcurrent tripping device 7 generates a signal by which the electromagnetic repulsion coil 3 is excited to induce an electromagnetic repulsive force between it and the short-circuit ring 4. At a time $t_0$ indicated in FIG. 9, the movable electrode **2*b* of the vacuum interrupter 2 parts or separates from the fixed electrode 2*a* thereof, and an electric arc strikes across the movable electrode 2*b* and the fixed electrode 2*a*. On this occasion, the electric arc undergoes an axial magnetic flux 9 (shown in FIG. 9) generated axially of the vacuum interrupter 2 by the fixed electrode 2*a* (constituting first magnetic flux generation means, and being a contact) and the movable electrode 2*b* (constituting the first magnetic flux generation means, and being another contact) themselves. The electric arc is therefore kept stable across both the electrodes 2*a* and 2*b***.

At a time $t_2$ after the opening of the vacuum interrupter 2, the trigger gap 8 is ignited or sparked by a signal which is delivered from the overcurrent tripping device 7. Then, a closed circuit extending along the commutating capacitor 5—commutating reactor 6—trigger gap 8—vacuum interrupter 2 is established. Thus, the charge stored in the commutating capacitor 5 beforehand is discharged, and a reverse current $I_{C1}$ flows in a direction reverse to that of the current of the main circuit of the circuit breaker 1.

Owing to the reverse current $I_{C1}$, a current $(I_0+I_{C1})$ flowing through the vacuum interrupter 2 reaches the zero point of the currents at a time $t_3$. Then, the electric arc in the vacuum interrupter 2 is extinguished, and the main circuit current is commutated to a circuit path consisting of the commutating capacitor 5—commutating reactor 6—trigger gap 8.

Consequently, energy having been stored in the inductance of the load (11) side changes into energy for charging the commutating capacitor 5, so that the terminal voltage of the commutating capacitor 5 rises. When terminal voltage has reached the operating voltage of the ZnO non-linear resistance element 9, this non-linear resistor 9 conducts to discharge the stored charge of the commutating capacitor 5. Then, the breaking operation the circuit breaker 1 is completed.

With the prior-art technique, as illustrated in FIG. 9, the attenuation rate of the axial magnetic flux $\phi_0$ generated between the electrodes **2*a* and 2*b*** by these electrodes themselves on the basis of the overcurrent $I_0$ flowing through the main circuit is low with respect to the period of the reverse current $I_{C1}$ which begins to be introduced at the time $t_2$. As indicated at symbol $\phi_0'$, therefore, a flux $\phi_r$ remains even at that zero point of the sum current $(I_0+I_{C1})$ of the main circuit which is developed at the time $t_3$ by the reverse current $I_{C1}$.

On account of the residual flux $\phi_r$, charged particles existing between the electrodes **2*a* and 2*b* are hindered from diffusing radially of the vacuum interrupter 2 at the current zero point at the time $t_3$, and a recovery rate the insulation between these electrodes lowers. As a result, the electrodes 2*a* and 2*b* fail to withstand a transient recovery voltage, and they strike an electric arc again. Thus, the breaking performance of the circuit breaker 1** is suppressed disadvantageously.

SUMMARY OF THE INVENTION

An object of the present invention is to eliminate the disadvantage of the prior art stated above, and to provide a vacuum circuit breaker which exhibits a high breaking performance between electrodes (or contacts).

In order to accomplish the object, the present invention proposes a vacuum circuit breaker having first magnetic flux generation means capable of generating a magnetic flux, and at least one pair of contacts for switching an electric circuit; comprising at least one second magnetic flux generation means for generating a magnetic flux so as to cancel the magnetic flux generated by the first magnetic flux generation means; and a power supply circuit which causes current to flow through the second magnetic flux generation means.

The magnetic flux generated between the contacts is canceled in advance of the zero point of the current between these contacts, whereby charged particles existing between these contacts are not hindered from diffusing at the current zero point. Consequently, the characteristic of dielectric recovery after the interruption of the current can be enhanced to improve the breaking performance of the vacuum circuit breaker.

PREFERRED EMBODIMENTS OF THE INVENTION

According to the vacuum circuit breaker of the invention, a coil (an external coil or second magnetic flux generation means) is disposed outside a vacuum interrupter in such a manner as to surround the main electrodes (or contacts) of the vacuum interrupter, and current is conducted to the coil in time with the introduction of a reverse current (reverse in direction to a main current which flows through a main circuit including the main electrodes) into the vacuum interrupter. In this regard, the structure of the coil and the value of the current to be conducted to the coil are properly set so as to cancel or nullify the residual magnetic flux between the main electrodes at the zero point of the main current.

As a result, charged particles existing between the main electrodes are not hindered from diffusing radially of the vacuum interrupter at the current zero point. Therefore, the rate of dielectric recovery between the main electrodes is not suppressed, and the breaking performance of the vacuum circuit breaker can be enhanced.

Now, the preferred embodiments of the present invention will be described in conjunction with the accompanying drawings.

Figure 1:
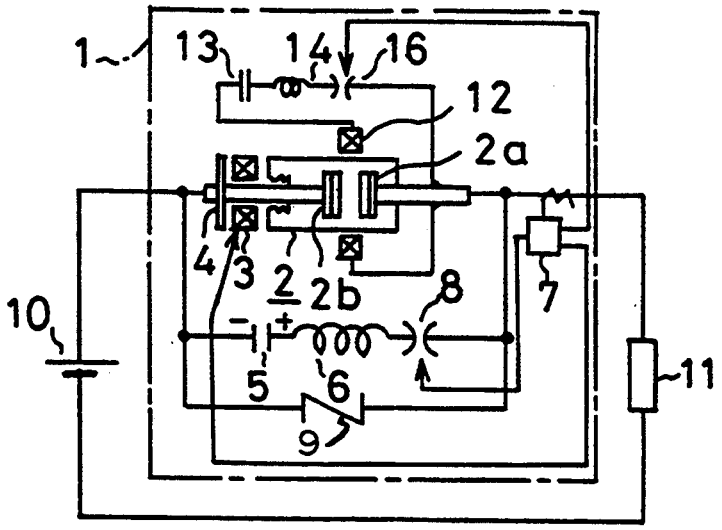
FIG. 1 is a circuit diagram showing the first embodiment of the present invention.
Figure 2:
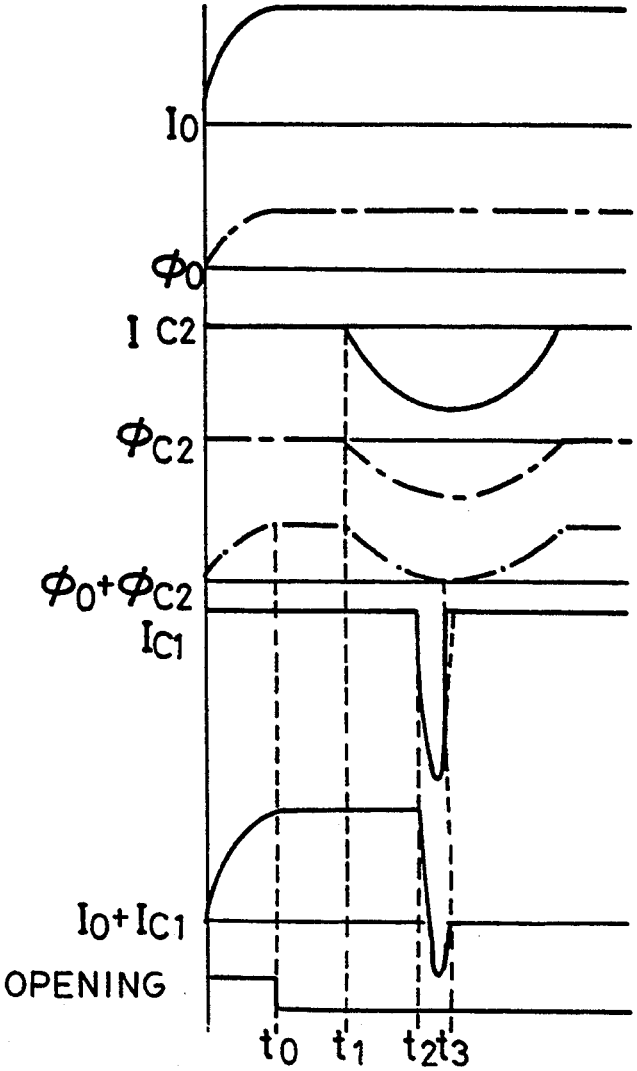
FIG. 2 is a diagram for explaining the operating principles of the first embodiment of the present invention.

FIG. 1 is a circuit diagram showing one embodiment of the present invention, while FIG. 2 is a diagram explaining the operating principles of the embodiment shown in FIG. 1.

Referring to FIG. 1, a DC (direct-current) circuit breaker 1 is constructed having a vacuum interrupter 2, a commutating capacitor 5, a commutating reactor 6, a trigger gap 8, an electromagnetic repulsion coil 3, a short-circuit ring 4, an overcurrent tripping device 7, and a zinc-oxide (ZnO) non-linear resistance element 9. It comprises an external coil 12 which is arranged outside the vacuum interrupter 2 in order to cancel a residual magnetic flux, and a capacitor 13, a reactor 14 and a trigger gap 16 which constitute a power supply circuit for conducting current to the external coil 12. Numeral 10 designates a DC power source, and numeral 11 a load.

The circuit breaker 1 thus constructed operates as explained below, reference being made also to FIG. 2. The commutating capacitor 5 is previously charged by an unshown charging device so as to store charge in an illustrated polarity. When an overcurrent $I_0$ flows through the main circuit of the circuit breaker 1 (including main electrodes 2*a* and 2*b*), it is detected by the overcurrent tripping device 7. Simultaneously with the detection, the overcurrent tripping device 7 generates a signal by which the electromagnetic repulsion coil 3 is excited to induce an electromagnetic repulsive force between it and the short-circuit ring 4. At a time $t_0$, the movable electrode 2*b* of the vacuum interrupter 2 parts or separates from the fixed electrode 2*a* thereof, and an electric arc strikes across the movable electrode 2*b* and the fixed electrode 2*a*. On this occasion, the electric arc undergoes an axial magnetic flux generated axially of the vacuum interrupter 2 by coil electrodes arranged at the back of the fixed electrode 2*a* and the movable electrode 2*b*. The electric arc is therefore kept stable across both the electrodes 2*a* and 2*b*.

At a time $t_1$ after the opening of the vacuum interrupter 2, the trigger gap 16 is ignited or sparked (i. e., is electrically closed by arcing) by a signal which is delivered from the overcurrent tripping device 7. Then, a closed circuit extending through the capacitor 13—reactor 14—trigger gap 16—external coil 12 constituting the power supply circuit of the external coil 12 is established. Thus, the charge stored in the power supply capacitor 13 is discharged, and a current $I_{C2}$ flows through the external coil 12. Owing to this current $I_{C2}$, an axial magnetic flux $\phi_{C2}$ opposite in polarity to the axial magnetic flux $\phi_0$ generated by the main electrodes 2*a*, 2*b* themselves is applied between these electrodes.

Herein, the trigger gap 8 is ignited or sparked (i.e., is electrically closed by arcing) by a signal which is delivered from the overcurrent tripping device 7 at a time $t_2$, in order that a sum current $(I_0+I_{C1})$ flowing through the vacuum interrupter 2 may form the zero point of currents at a time $t_3$ at which the sum axial magnetic flux between the main electrodes 2*a*, 2*b* becomes sufficiently low. Then, a closed circuit extending along the commutating capacitor 5—commutating reactor 6—trigger gap 8—vacuum interrupter 2 is established. Thus, the charge stored in the commutating capacitor 5 beforehand is discharged, and a reverse current $I_{C1}$ flows in a direction reverse to that of the current of the main circuit of the circuit breaker 1.

Owing to the reverse current $I_{C1}$, the current $(I_0+I_{C1})$ flowing through the vacuum interrupter 2 reaches the zero point at the time $t_3$. Then, the electric arc in the vacuum interrupter 2 is extinguished. At this time, the axial magnetic flux between the main electrodes 2*a*, 2*b* as denoted by $(\phi_0+\phi_{C2})$ is suppressed to a sufficiently low level, and charged particles existing between these electrodes are not hindered from diffusing radially of the vacuum interrupter 2. Therefore, the circuit breaker 1 demonstrates a favorable dielectric recovery characteristic.

After the main circuit current has been cut off, it is commutated to a circuit path consisting of the commutating capacitor 5—commutating reactor 6—trigger gap 8. Consequently, energy having been stored in the inductance of the load (11) side changes into energy for charging the commutating capacitor 5, so that the terminal voltage of the commutating capacitor 5 rises. When the terminal voltage has reached the operating voltage of the ZnO non-linear resistance element 9, this resistor 9 conducts to discharge the stored charges of the commutating capacitor 5. Then, the breaking operation of the circuit breaker 1 is completed.

As stated above, the axial magnetic flux between the main electrodes is canceled before the introduction of the reverse current, whereby the dielectric recovery characteristic after the interruption of the current can be enhanced to improve the breaking performance of the vacuum circuit breaker.

In FIGS. 3 thru 7 to be referred to below, constituents identical or corresponding to those in FIG. 1 are respectively denoted by the same symbols as in FIG. 1, and they shall not be repeatedly explained.

Figure 3:
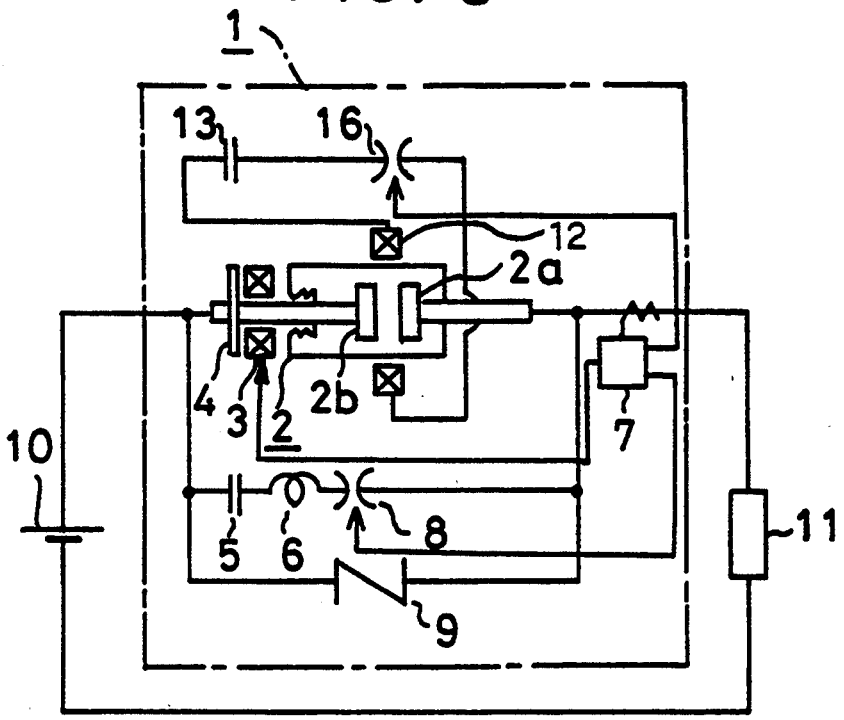
FIG. 3 is a circuit diagram showing the second embodiment of the present invention.

FIG. 3 is a circuit diagram showing the second embodiment of the present invention. This embodiment consists in that the reactor (14 in FIG. 1) in the power supply circuit of the external coil 12 is dispensed with by appropriately setting the inductance of the external coil 12. Since the number of parts is reduced, the circuit breaker 1 of this embodiment can have its cost curtailed and its reliability heightened. Even with this embodiment, a function and an effect similar to those of the embodiment shown in FIG. 1 can be attained.

Figure 4:
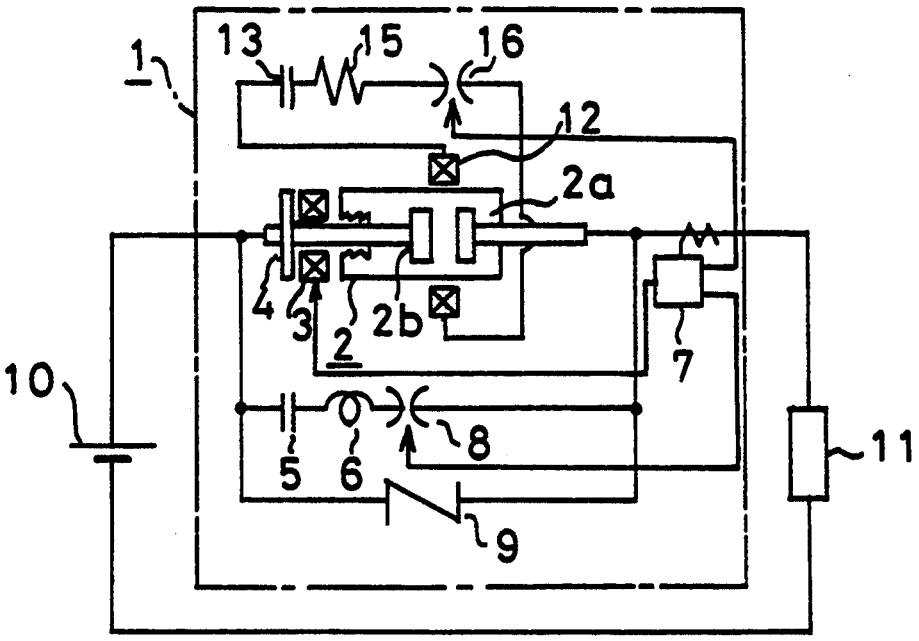
FIG. 4 is a circuit diagram showing the third embodiment of the present invention.

FIG. 4 is a circuit diagram showing the third embodiment of the present invention. This embodiment consists in that the power supply circuit of the external coil 12 is constituted by the capacitor 13, a resistor 15 and the trigger gap 16. In this embodiment, the semi-steady part of the current $I_{C2}$ to be conducted to the external coil 12 can be set longer than in the embodiment shown in FIG. 1 or FIG. 3. Therefore, the circuit breaker 1 of this embodiment has the feature that the resultant magnetic flux ($\phi_0+\phi_{C2}$) in the axial direction of the vacuum interrupter 2 can be nullified in semi-steady fashion for a longer time period.

Figure 5:
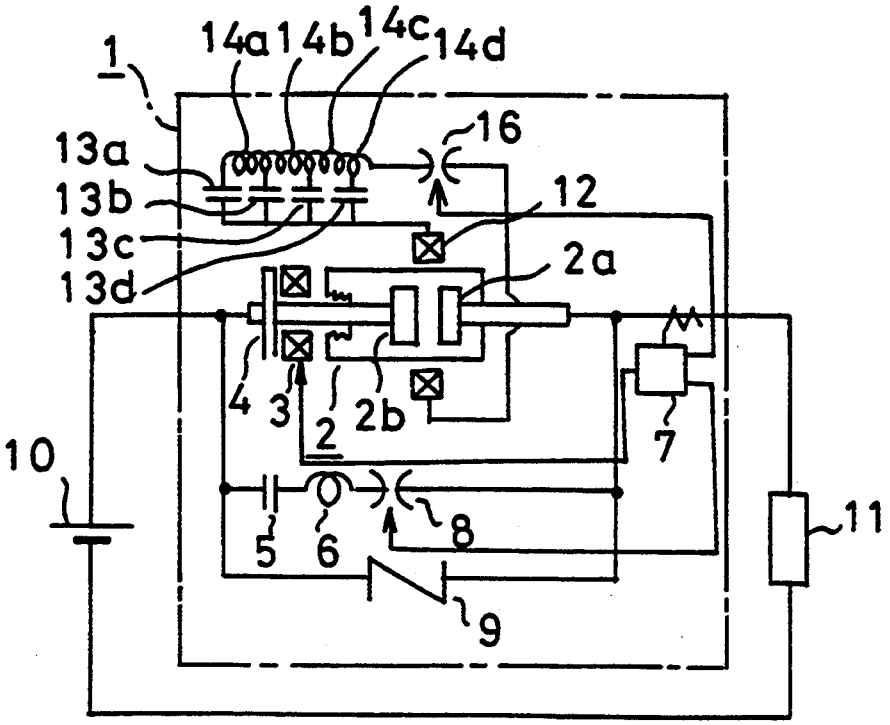
FIG. 5 is a circuit diagram showing the fourth embodiment of the present invention.

FIG. 5 is a circuit diagram showing the fourth embodiment of the present invention. In this embodiment, the power supply circuit of the external coil 12 is constituted by the trigger gap 16 and a $\pi$ (pi) network in which capacitors 13*a*~13*d* and reactors 14*a*~14*d* are connected. Thus, this embodiment has the feature that the semi-steady part of the current $I_{C2}$ to flow through the external coil 12 can be made still longer than in the embodiment of FIG. 4, so the time $t_2$ at which the reverse current $I_{C1}$ is introduced into the vacuum interrupter 2 as illustrated in FIG. 2 can be set more freely.

Figure 6:
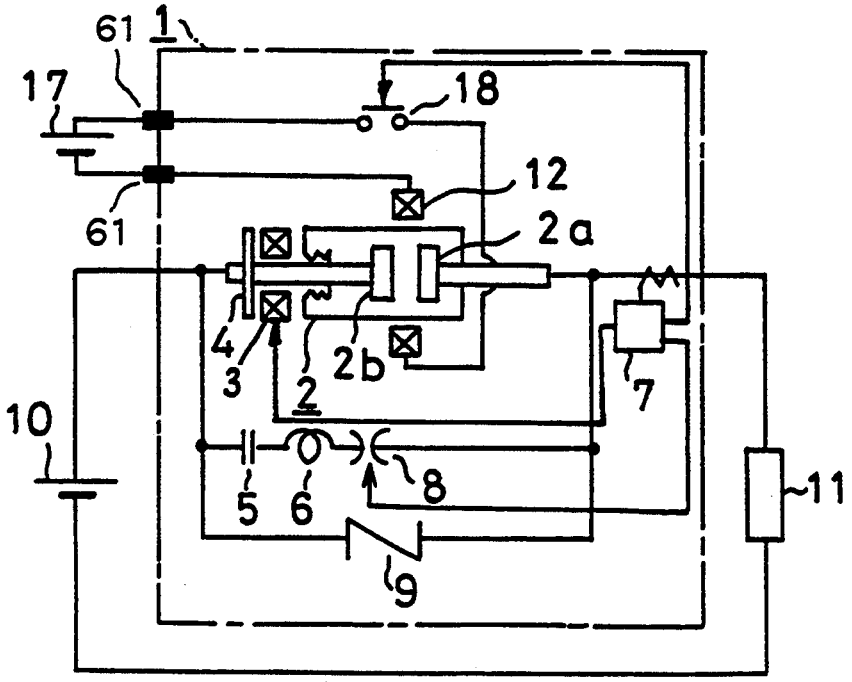
FIG. 6 is a circuit diagram showing the fifth embodiment of the present invention.

FIG. 6 is a circuit diagram showing the fifth embodiment of the present invention. This embodiment is an example in which the current $I_{C2}$ to be conducted to the external coil 12 is fed through feed terminals 61 from a DC power source 17 disposed outside the circuit breaker 1. The circuit breaker 1 in this embodiment has the feature of a curtailed cost because the capacitor (13 or the like) for feeding the current $I_{C2}$ to the external coil 12 need not be included within the circuit breaker 1. In this embodiment, the supply voltage of the external coil 12 is low, and the current $I_{C2}$ to flow therethrough does not have a zero point naturally, so that the current is controlled by a switch 18.

This embodiment, per se, consists in locating the power supply of the external coil 12 outside the vacuum circuit breaker 1. Alternatively, the external coil 12 may well be fed with the current $I_{C2}$ from the power supply of the electromagnetic repulsion coil 3 or the power supply for the commutating circuit (at the numerals 5, 6 and 8) while the phase of the power supply is being controlled. With this measure, the cost of the circuit breaker 1 can be further curtailed.

Figure 7:
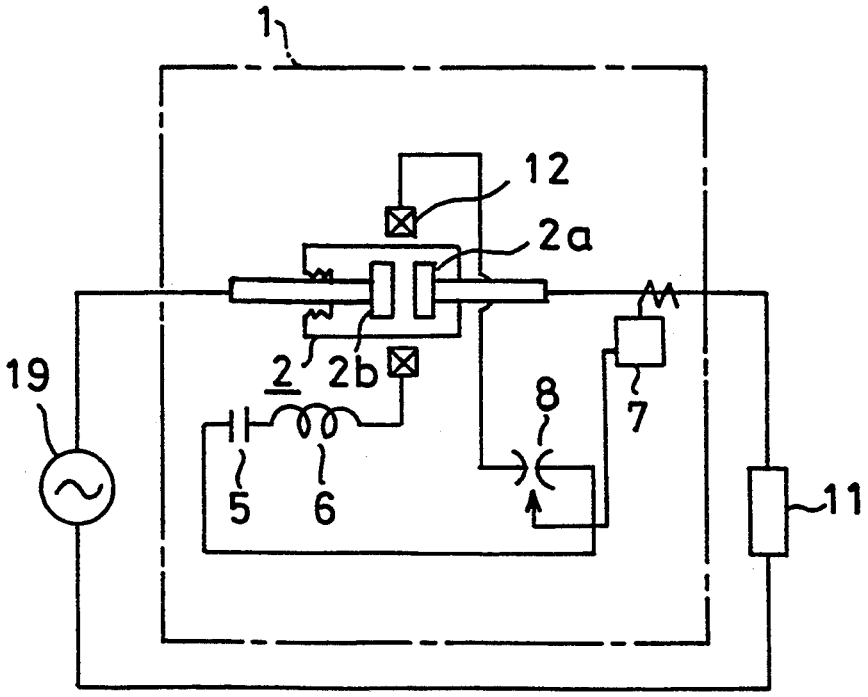
FIG. 7 is a circuit diagram showing the sixth embodiment of the present invention.
Figure 8:
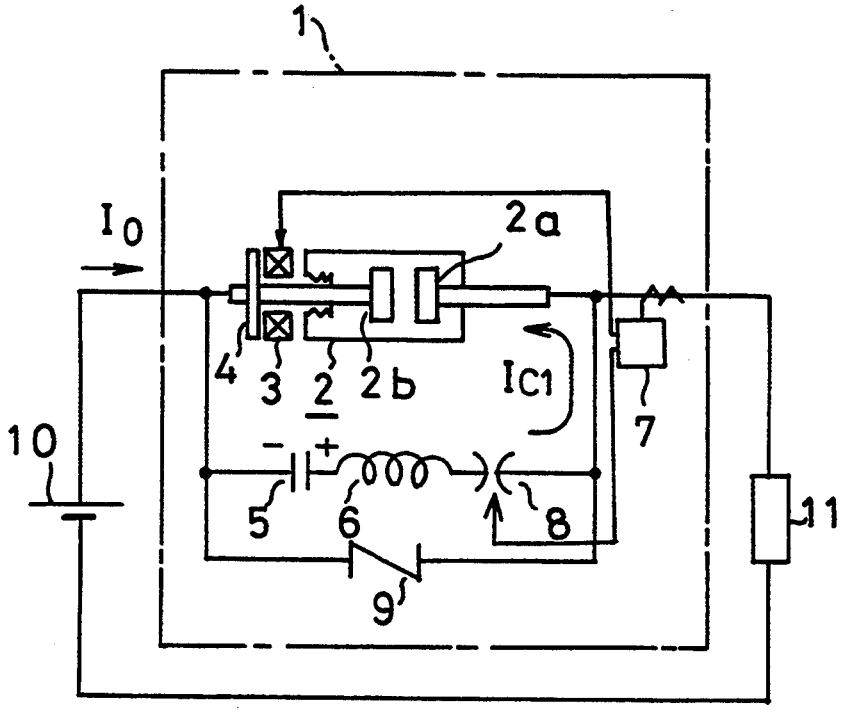
FIG. 8 PRIOR ART
FIG. 8 is a circuit diagram of a DC (direct-current) circuit breaker in the prior art.
Figure 9:
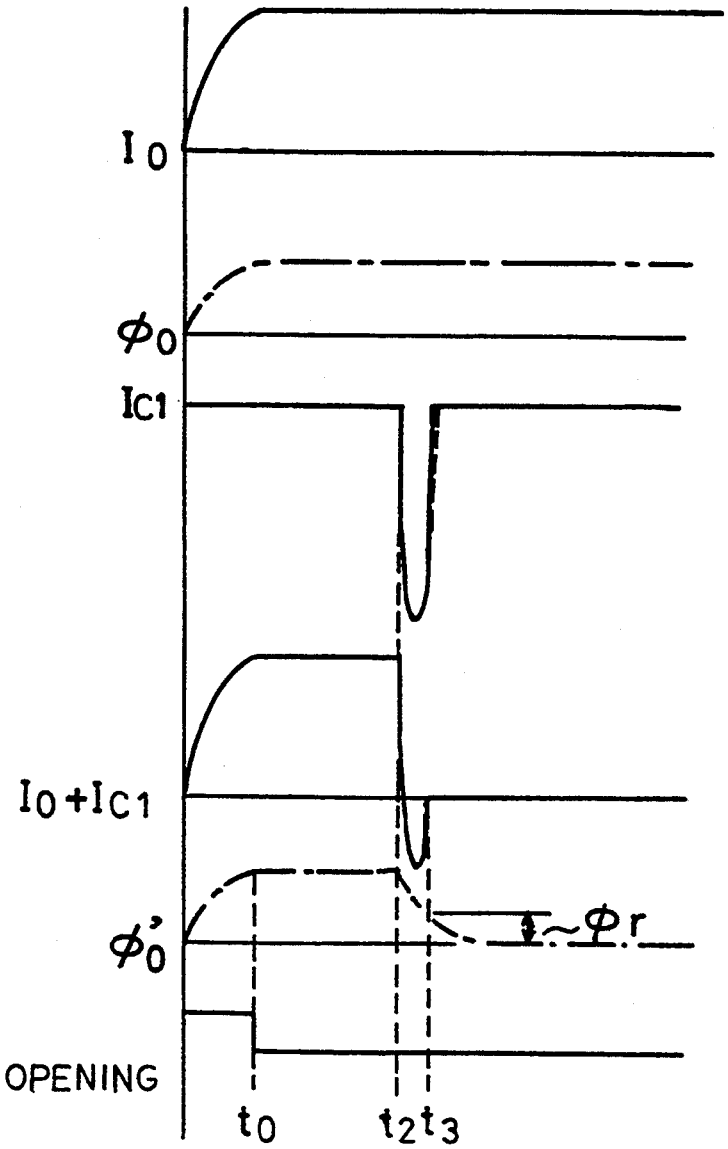
FIG. 9 PRIOR ART
FIG. 9 is a diagram for explaining the operating principles of the prior-art DC circuit breaker.

FIG. 7 is a circuit diagram showing the sixth embodiment of the present invention. Numeral 19 designates an AC (alternating-current) power source. This embodiment is an example in which an AC circuit breaker adopts residual-magnetic-field cancellation means configured of the external coil 12, and the capacitor 5, reactor 6 and gap switch 8 constituting the power supply of the coil 12. In the case of alternating current, the rate of change thereof at a current zero point is proportional to the magnitude thereof. In cutting off a large current, therefore, the problem of a residual magnetic flux is posed by the same phenomenon as in the DC circuit breaker. Accordingly, when the axial magnetic flux between the electrodes 2*a* and 2*b* is canceled in advance of the current zero point, a favorable dielectric recovery characteristic can be attained to enhance the breaking performance of the circuit breaker 1.

As thus far described, according to the present invention, the axial magnetic flux between the main electrodes is canceled in advance of the zero point of the current between these electrodes, whereby the charged particles existing between these electrodes are not hindered from diffusing radially of the vacuum interrupter at the current zero point. This brings forth the effect that the dielectric recovery characteristic after the interruption of the current can be enhanced to improve the breaking performance of the vacuum circuit breaker.

As set forth above, the present invention can provide a vacuum circuit breaker which exhibits a high breaking performance between electrodes (or contacts).

What is claimed is:

1. A vacuum circuit breaker, comprising:

at least one pair of opposed switchable contacts for making/breaking an electrical circuit;

first magnetic flux generation means for generating a magnetic flux in a space between said opposed contacts when said opposed contacts are parted so as to interrupt the electrical circuit;

at least one second magnetic flux generation means for generating a magnetic flux so as to cancel the magnetic flux generated by said first magnetic flux generation means sufficiently for charged particles in said space to diffuse radially from said space; and a power supply circuit which causes current to flow through said second magnetic flux generation means.

2. A vacuum circuit breaker, comprising:

a vacuum valve including at least first magnetic flux generation means having one pair of opposed switchable main electrodes which are arranged in a vacuum vessel for generating an axial magnetic flux component in a space between said main electrodes when said main electrodes are parted so as to interrupt an electrical circuit;

at least one second magnetic flux generation means for generating an axial magnetic flux component opposite in sense to the axial magnetic flux component generated by said main electrodes of said first magnetic flux generation means sufficiently for charged particles to diffuse radially from said space; and a power supply circuit which causes current to flow through said second magnetic flux generation means.

3. A vacuum circuit breaker according to claim 1, wherein said power supply circuit for conducting the current to said second magnetic flux generation means includes a capacitor, a reactor and a trigger gap.

4. A vacuum circuit breaker according to claim 2, wherein said power supply circuit for conducting the current to said second magnetic flux generation means includes a capacitor, a reactor and a trigger gap.

5. A vacuum circuit breaker according to claim 1, wherein said power supply circuit for conducting the current to said second magnetic flux generation means includes a capacitor and a trigger gap.

6. A vacuum circuit breaker according to claim 2, wherein said power supply circuit for conducting the current to said second magnetic flux generation means includes a capacitor and a trigger gap.

7. A vacuum circuit breaker according to claim 1, wherein said power supply circuit for conducting the current to said second magnetic flux generation means includes a capacitor, a resistor and a trigger gap.

8. A vacuum circuit breaker according to claim 2, wherein said power supply circuit for conducting the current to said second magnetic flux generation means includes a capacitor, a resistor and a trigger gap.

9. A vacuum circuit breaker according to claim 1, wherein said power supply circuit for conducting the current to said second magnetic flux generation means includes a trigger gap and a circuit having capacitors and reactors connected in a network.

10. A vacuum circuit breaker according to claim 2, wherein said power supply circuit for conducting the current to said second magnetic flux generation means includes a trigger gap and a circuit having capacitors and reactors connected in a network.

11. A vacuum circuit breaker, comprising:

at least one pair of opposed switchable contacts for making/breaking an electrical circuit;

first magnetic flux generation means for generating a magnetic flux in a space between said opposed contacts when said opposed contacts are parted so as to interrupt the electrical circuit;

at least one second magnetic flux generation means for generating a magnetic flux so as to cancel the magnetic flux generated by said first magnetic flux generation means sufficiently for charged particles in said space to diffuse radially from said space; and feed terminals which conduct current from outside said vacuum circuit breaker to said second magnetic flux generation means.

12. A vacuum circuit breaker, comprising:

a vacuum valve including at least first magnetic flux generation means having one pair of opposed switchable main electrodes which are arranged in a vacuum vessel for generating an axial magnetic flux component in a space between said main electrodes when said main electrodes are parted so as to interrupt an electrical circuit;

at least one second magnetic flux generation means for generating an axial magnetic flux component opposite in sense to the axial magnetic flux component generated by said main electrodes of said first magnetic flux generation means sufficiently for charged particles to diffuse radially from said space; and feed terminals which conduct current from outside said vacuum circuit breaker to said second magnetic flux generation means.

13. A vacuum circuit breaker according to claim 1, wherein said second magnetic flux generation means includes a coil surrounding said space.

14. A vacuum circuit breaker according to claim 2, wherein said second magnetic flux generation means further includes a coil surrounding said space.

15. A vacuum circuit breaker according to claim 11, wherein said second magnetic flux generation means includes a coil surrounding said space.

16. A vacuum circuit breaker according to claim 12, wherein said second magnetic flux generation means further includes a coil surrounding said space.

* * * * *